US008310430B2

(12) United States Patent
Hiratsuka

(10) Patent No.: US 8,310,430 B2
(45) Date of Patent: Nov. 13, 2012

(54) DISPLAY DEVICE AND DISPLAY DRIVER WITH OUTPUT SWITCHING CONTROL

(75) Inventor: Hitoshi Hiratsuka, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 951 days.

(21) Appl. No.: 12/292,203

(22) Filed: Nov. 13, 2008

(65) Prior Publication Data

US 2009/0135169 A1 May 28, 2009

(30) Foreign Application Priority Data

Nov. 27, 2007 (JP) ..... 2007-305939

(51) Int. Cl.
*G09G 3/36* (2006.01)

(52) U.S. Cl. ..... 345/100

(58) Field of Classification Search ..... 345/100; 377/75

See application file for complete search history.

(56) References Cited

U.S. PATENT DOCUMENTS

| | | | | |
|---|---|---|---|---|
| 2003/0169247 | A1* | 9/2003 | Kawabe et al. | 345/204 |
| 2004/0257350 | A1* | 12/2004 | Kobayashi | 345/204 |
| 2005/0068287 | A1* | 3/2005 | Lin et al. | 345/100 |
| 2005/0128169 | A1* | 6/2005 | Kang et al. | 345/87 |
| 2005/0128170 | A1* | 6/2005 | Kang et al. | 345/87 |
| 2005/0156850 | A1* | 7/2005 | Morita | 345/96 |
| 2005/0156865 | A1* | 7/2005 | Suh | 345/100 |
| 2006/0028426 | A1* | 2/2006 | Hiratsuka | 345/103 |
| 2006/0242358 | A1* | 10/2006 | Chen | 711/109 |
| 2009/0115716 | A1* | 5/2009 | Murakami et al. | 345/100 |

FOREIGN PATENT DOCUMENTS

| | | | |
|---|---|---|---|
| JP | 63-120569 | A | 5/1988 |
| JP | 4-170515 | A | 6/1992 |
| JP | 7-78672 | | 8/1995 |
| JP | 2002-162928 | A | 6/2002 |
| JP | 2002-352593 | A | 12/2002 |
| JP | 2005-215007 | | 8/2005 |
| WO | WO2006134885 | * | 12/2006 |

OTHER PUBLICATIONS

Japanese Office Action dated Apr. 25, 2012, with partial English-language translation.

* cited by examiner

*Primary Examiner* — Chanh Nguyen
*Assistant Examiner* — Robert Stone
(74) *Attorney, Agent, or Firm* — McGinn IP Law Group, PLLC

(57) ABSTRACT

A driver includes a plurality of output portions; and an output switching control portion. The plurality of output portions is synchronized with a shift pulse signal. The shift pulse signal indicates one specification shift pulse signal among a plurality of specification shift pulse signals. The plurality of specification shift pulse signals indicates a plurality of output numbers which are different from each other based on respective specifications of the plurality of specification shift pulse signals. The one specification shift pulse signal indicates a setting output number as one output number among the plurality of output numbers. The output switching control portion selects a group of output portions corresponding to the setting output number among the plurality of output portions based on the one specification shift pulse signal. The group of output portions loads display data in synchronization with the shift pulse signal, and outputs output grayscale voltages corresponding to the display data to a display portion.

11 Claims, 4 Drawing Sheets

DISPLAY DEVICE AND DISPLAY DRIVER WITH OUTPUT SWITCHING CONTROL

INCORPORATION BY REFERENCE

This application is based upon and claims the benefit of priority from Japanese patent application No. 2007-305939 filed on Nov. 27, 2007the disclosure of which is incorporated herein in its entirety by reference.

BACKGROUND OF THE INVENTION

1. Field of the Invention

The present invention relates to a driver for displaying display data and a display device using the driver.

2. Description of Related Art

A display device such as a TFT (Thin Film Transistor) liquid crystal display device, a simple matrix liquid crystal display device, an electroluminescence (EL) display device, and a plasma display device becomes widely used. Each of these display devices includes a display portion and a driver for displaying display data on the display portion.

As techniques related to the driver, Japanese Laid-Open Patent Application JP 2005-215007A and Japanese Laid-Open Patent Application JP-Heisei 07-78672A disclose drivers which are able to switch the number of outputs (the output number) based on resolution of the display portion. These drivers employ a configuration in which an output number control signal for switching the output number is supplied from outside to the driver that does not include an output number switch function for switching the number of outputs.

We have now discovered the following facts. As described above, for example, in a case where the output number of the driver can be switched to one of a first output number and the second output number, the drivers described in JP 2005-215007A and JP-Heisei 07-78672A are required to supply the output number control signal indicating one of the output numbers to the driver. In this case, it is also required to provide an output number control terminal for supplying the output number control signal on a chip. However, in a case where the output number of the driver is not switched, it is not required normally to provide the output number control terminal on the chip.

In the case where the output number of the driver is switched as described above, since the output number control terminal is provided on the chip, it is required to mount a device for supplying the output number control signal to the output number control terminal and a device for setting a signal level of the output number control signal in a display device. In this case, wirings are also needed for connecting the above mentioned devices to the output number control terminal. This prevents a frame of non-displayed area portion on a periphery of a liquid crystal panel from being narrowed. In addition, costs are required for mounting the above mentioned devices and for wiring them.

SUMMARY

The present invention seeks to solve one or more of the above problems, or to improve upon those problems at least in part. In one embodiment, a driver includes: a plurality of output portions configured to be synchronized with a shift pulse signal, wherein the shift pulse signal indicates one specification shift pulse signal among a plurality of specification shift pulse signals, wherein the plurality of specification shift pulse signals indicates a plurality of output numbers which are different from each other based on respective specifications of the plurality of specification shift pulse signals, wherein the one specification shift pulse signal indicates a setting output number as one output number among the plurality of output numbers; and an output switching control portion configured to select a group of output portions corresponding to the setting output number among the plurality of output portions based on the one specification shift pulse signal, wherein the group of output portions loads display data in synchronization with the shift pulse signal, and outputs output grayscale voltages corresponding to the display data to a display portion.

In another embodiment, a display device includes: a display portion; a timing controller configured to supply display data and a shift pulse signal; and a driver configured to include a plurality of output portions synchronized with the shift pulse signal, wherein the shift pulse signal indicates one specification shift pulse signal among a plurality of specification shift pulse signals, wherein the plurality of specification shift pulse signals indicates a plurality of output numbers which are different from each other based on respective specifications of the plurality of specification shift pulse signals, and wherein the one specification shift pulse signal indicates a setting output number as one output number among the plurality of output numbers, wherein the driver further includes: an output switching control portion configured to select a group of output portions corresponding to the setting output number among the plurality of output portions based on the one specification shift pulse signal, wherein the group of output portions loads display data in synchronization with the shift pulse signal, and outputs output grayscale voltages corresponding to the display data to a display portion.

The display device of the present invention can switch a specification of the source driver to one of a plurality of specifications (e.g. 414 outputs and 384 outputs). The shift pulse signal (STH) shows a shift pulse signal for one specification among the shift pulse signals for the plurality of specifications (e.g. STHa and STHb), and the shift pulse signals for the plurality of specifications (e.g. STHa and STHb) show output numbers (e.g. "414" and "384") which differ depending on the specifications, respectively. Accordingly, the display device of the present invention supplies the above described shift pulse signal (STH (e.g. STHa or STHb)) to the source driver. As described above, in the display device of the present invention, it is enough to provide the shift pulse input terminal for supplying the above described shift pulse signal (STH (e.g. STHa and STHb)) to the source driver on a chip and it is not required to provide the above mentioned output number control terminal on the chip.

In addition, the display device of the present invention does not require to mount a device for supplying the output number control signal to the output number control terminal and a device for setting a signal level of the output number control signal in the display device. In this case, wirings for connecting the above mentioned devices to the output number control terminal on the chip are not required. This realizes narrowing a frame of non-displayed area part on a periphery of a liquid crystal panel. In addition, costs for mounting the above mentioned devices and for wiring them are not required, and a cost reduction can be realized.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

A display device including a driver according to an embodiment of the present invention will be described in detail below with reference to attached drawings. The display device according to the embodiment of the present invention can be applied to a TFT (Thin Film Transistor) liquid crystal display device, a simple matrix liquid crystal display device, an electroluminescence (EL) display device, a plasma display device, and the like.

[Configuration]

Figure 1:
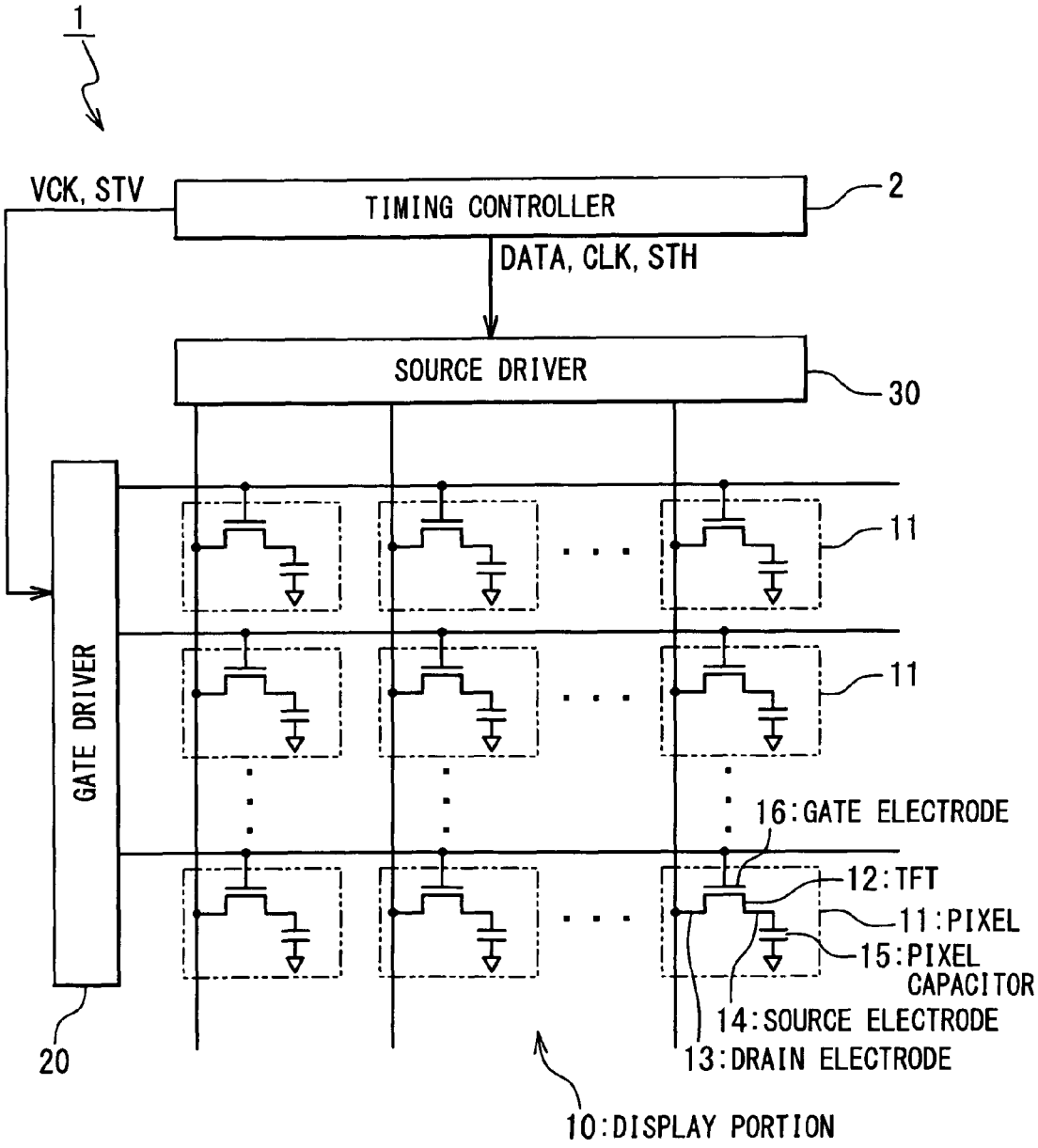
FIG. 1 is a view showing a configuration of a TFT liquid crystal display device as a display device according to an embodiment of the present invention.

FIG. 1 is a view showing a configuration of a TFT liquid crystal display device 1 as a display device according to the embodiment of the present invention.

The TFT liquid crystal display device 1 according to the embodiment of the present invention includes a display portion (liquid crystal panel) 10 which is an LCD (Liquid Crystal Display) module. The display panel 10 includes a plurality of pixels 11 arranged in a matrix shape. Each of the plurality of the pixels 11 includes a thin film transistor (TFT) 12 and a pixel capacitor 15. The pixel capacitor 15 includes a pixel electrode and an opposite electrode facing the pixel electrode. The TFT 12 includes a drain electrode 13, a source electrode 14 connected to the pixel electrode, and a gate electrode 16.

The TFT type liquid crystal display device 1 according to the embodiment of the present invention further includes a plurality of gate lines and a plurality of data lines. Each of the plurality of the gate lines is connected to the gate electrodes 16 of the TFTs 12 in the pixels 11 provided in a row. Each of the plurality of the data lines is connected to the drain electrodes 13 of the TFTs 12 in the pixels 11 provided in a column.

The TFT liquid crystal display device 1 according to the embodiment of the present invention further includes a gate driver 20 and a source driver 30 as a driver for driving the plurality of the pixels 11 of the liquid crystal panel 10. The gate driver 20 is provided on a chip (not shown in the figure), and is connected to the plurality of the gate lines. The source driver 30 is provided on the chip, and is connected to the plurality of the data lines.

The TFT liquid crystal display device 1 according to the embodiment of the present invention further includes a timing controller 2. The timing controller 2 is provided on the chip.

The timing controller 2 outputs a vertical clock signal VCK having a period of a single horizontal period and a vertical shift pulse signal STV for selecting the plurality of the gate lines in series from a first gate line to a last gate line. For example, in the single horizontal period, the gate driver 20 outputs a selected signal to one gate line among the plurality of the gate lines (selects the foregoing one gate line) based on the vertical shift pulse signal STV and the vertical clock signal VCK. This selected signal is supplied to the gate electrodes 16 of the TFTs 12 in the pixels 11 in a single line corresponding to the foregoing one gate line, and the TFTs 12 are turned to be on by the selected signal. The other gate lines also operate in a same manner.

The timing controller 2 outputs display data DATA, a clock signal CLK, and a shift pulse signal STH to the source driver 30.

Specifically, the timing controller 2 outputs the display data DATA of the first line to the last line in this order to the source driver 30 as the display data DATA of a single screen (a single frame) displayed in the liquid crystal panel 10. The display data DATA of a single line includes plural pieces of display data respectively corresponding to the plurality of the data lines. The source driver 30 outputs the plural pieces of display data respectively to the plurality of the data lines based on the shift pulse signal STH and the clock signal CLK. At this moment, the TFT 12 in the pixel 11 corresponding to a single gate line among the plurality of the gate lines and to the plurality of the data lines is on. For this reason, the plural pieces of display data are written to the pixel capacitors 15 in the foregoing pixels 11 and are held until next writing, respectively. Thus, the display data DATA of the single line is displayed.

Figure 2:
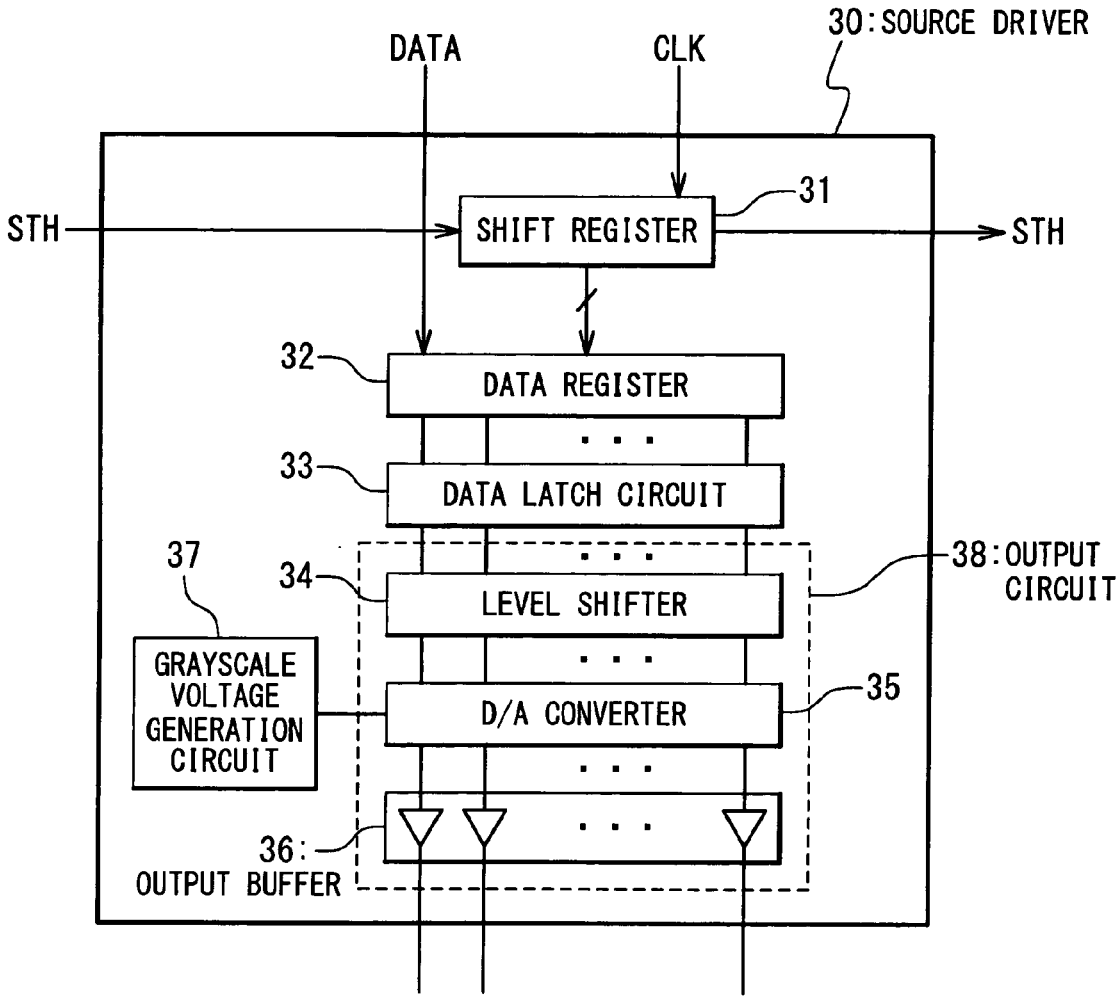
FIG. 2 is a view showing a configuration of a source driver according to the embodiment of the present invention.

FIG. 2 is a view showing a configuration of the source driver 30 according to the embodiment of the present invention.

The source driver 30 includes a shift register 31, a data register 32, a data latch circuit 33, a grayscale voltage generation circuit 37, and an output circuit 38. The output circuit 38 includes a level shifter 34, a digital/analog (D/A) converter 35, and an output buffer 36. The shift register 31 is connected to the data register 32, and the data register 32 is connected to the data latch circuit 33. The data latch circuit 33 is connected to the level shifter 34, and the level shifter 34 is connected to the D/A converter 35. The D/A converter 35 is connected to the output buffer 36 and to the grayscale voltage generation circuit 37. The output buffer 36 is connected to the plurality of the data lines.

The grayscale voltage generation circuit 37 includes a plurality of gradation resistance elements connected in series. This grayscale voltage generation circuit 37 voltage-divides a reference voltage supplied from a power source circuit (not shown in the figure) by using the plurality of the gradation resistance elements and generates a plurality of grayscale voltages.

An operation of the source driver 30 according to the embodiment of the present invention will be described below.

For example, it is assumed that a plurality of the source drivers 30 exist in the first stage to the last stage and that the plurality of the source drivers 30 are connected in cascade (a cascade connection) in a column direction from the first stage to the last stage in this order. In addition, it is assumed that the foregoing display portion 10 is provided to each of the plurality of the source drivers 30. Each of the plurality of the source drivers 30 is set to a single chip to be an IC as a driver IC. The timing controller 2 supplies the clock signal CLK and the display data DATA of the single line to each source driver 30 and supplies the shift pulse signal STH to the source driver 30 in the first stage. Each source driver 30 outputs plural pieces of the display data included in the display data DATA of the single line to the plurality of the data lines based on the clock signal CLK and the shift pulse signal STH.

In each source driver 30, the shift register 31 synchronizes the shift pulse signals STH with the clock signal CLK and shifts the shift pulse signals STH in turn, and outputs them to the data register 32. The shift pulse signal STH is outputted from an input or an output of the shift register 31 to the next source driver 30. In the source driver 30 in the last stage, the shift register 31 synchronizes the shift pulse signals STH with the clock signal CLK and shifts the shift pulse signals STH in turn, and outputs them to the data register 32.

In each source driver 30, the data register 32 loads plural pieces of the display data from the timing controller 2 in synchronism with the shift pulse signal STH from the shift register 31 and outputs the plural pieces of the display data to the data latch circuit 33. The data latch circuit 33 latches the plural pieces of the display data respectively at the same timing, and outputs the plural pieces of the display data to the level shifter 34. The level shifter 34 performs a level conversion on the plural pieces of the display data and outputs the converted plural pieces of the display data to the D/A converter 35. The D/A converter 35 performs a digital/analog conversion on the plural pieces of the display data from the level shifter 34. That is, the D/A converter 35 selects a plurality of the output grayscale voltages respectively corresponding to the plural pieces of the display data from the level shifter 34 and outputs the output grayscale voltages to the output buffer 36. The output buffer 36 outputs the plurality of the output grayscale voltages to the plurality of the data lines, respectively.

The above mentioned source driver 30 can switch its output number based on a resolution of the liquid crystal panel 10. In this case, one specification among a plurality of the specifications is used as the output number of the source driver 30. For example, it is assumed that a plurality of the specifications of the source driver 30 includes a first specification and a second specification, and it is assumed that the output number is 414 (hereinafter referred to as 414 outputs) in the first specification and that the output number is 384 (hereinafter referred to as 384 outputs) in the second specification.

In the first specification, in a case where a horizontal resolution of the liquid crystal panel 10 is 1380 pixels, 4140 outputs are required as the output number of the source driver 30, which is calculated by: 1380×3 (RGB)=4140.

When the source driver 30 is set to the 414 outputs, 10 source drivers are required as the source drivers 30, which is calculated by: 4140/414=10.

In the second specification, in a case where a horizontal resolution of the liquid crystal panel 10 is 1280 pixels, 3840 outputs are required as the output number of the source driver 30, which is calculated by: 1280×3 (RGB)=3840.

When the source driver 30 is set to the 384 outputs, 10 source drivers are required as the source drivers 30, which is calculated by: 3840/384=10.

Figure 3:
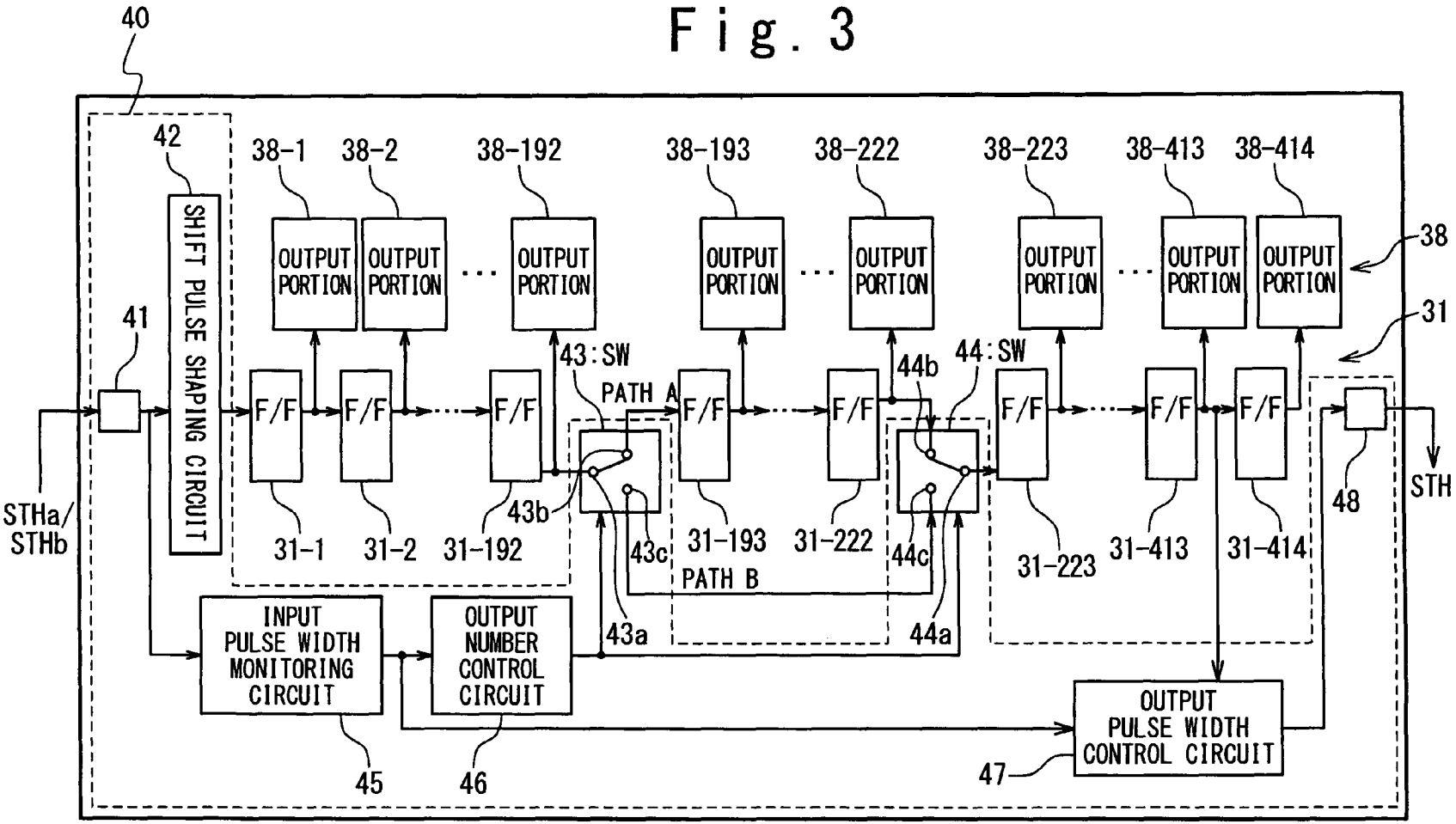
FIG. 3 is a view showing a configuration of a source driver able to switch the output number between the 384 outputs and 414 outputs as the configuration of the source driver according to the embodiment of the present invention.

FIG. 3 is a view showing a configuration of a source driver able to switch the output number between the 384 outputs and 414 outputs as the configuration of the above mentioned source driver 30. Here, the output number of the source driver 30 is assumed to be 414.

The source driver 30 includes flip-flop circuits (F/F) 31-1 to 31-414 provided on the chip and output portions 38-1 to 38-414. The flip-flop circuits 31-1 to 31-414 correspond to the above mentioned shift register 31. The output portions 38-1 to 38-414 correspond to the above mentioned data register 32, data latch circuit 33, level shifter 34, D/A converter 35, and output buffer 36.

The source driver 30 further includes an output switching control portion 40 provided on the chip. The output switching control part 40 includes a shift pulse input terminal 41, a shift pulse shaping circuit 42, an output number switches 43 and 44, an input pulse width monitoring circuit 45, an output number control circuit 46, an output pulse width control circuit 47, and a shift pulse output terminal 48. The output number switch 43 includes terminals 43*a*, 43*b*, and 43*c*. The output number switch 44 includes terminals 44*a*, 44*b*, and 44*c*.

To the shift pulse input terminal 41, a shift pulse signal STHa for the first specification (mentioned below) or a shift pulse signal STHb for the second specification (mentioned below) is supplied as the above mentioned shift pulse signal STH. The shift pulse input terminal 41 is connected to an input of the shift pulse shaping circuit 42. An output of the shift pulse shaping circuit 42 is connected to an input of the flip-flop circuit 31-1.

An input of the input pulse width monitoring circuit 45 is connected to the shift pulse input terminal 41. The input pulse width monitoring circuit 45 monitors a pulse width of the shift pulse signal STH supplied to the shift pulse input terminal 41. When the pulse width of the shift pulse signal STH corresponds to P number of periods (P periods; P is a positive number) of the clock signal CLK, the input pulse width monitoring circuit 45, as a result of the monitoring, recognizes that the shift pulse signal STH is the shift pulse signal STHa for the first specification, and outputs a first specification control signal indicating the above mentioned "P" When the pulse width of the shift pulse signal STH corresponds to Q number of periods (Q periods; Q is a positive number different from the "P") of the clock signal CLK, the input pulse width monitoring circuit 45, as a result of the monitoring, recognizes that the shift pulse signal STH is the shift pulse signal STHb for the second specification, and outputs a second specification control signal indicating the above mentioned "Q".

The output of the input pulse width monitoring circuit 45 is connected to the input of the output number control circuit 46. An output of the output number control circuit 46 is connected to the output number switches 43 and 44. The output number control circuit 46 recognizes that the first and second specification control signals from the input pulse width monitoring circuit 45 indicate the first and second specifications (414 and 384 outputs) as the specifications of the source driver 30, respectively. When receiving the first specification control signal from the input pulse width monitoring circuit 45, the output number control circuit 46 controls the output number switches 43 and 44 on the basis of the first specification (the 414 outputs). When receiving the second specification control signal from the input pulse width monitoring circuit 45, the output number control circuit 46 controls the output number switches 43 and 44 on the basis of the second specification (the 384 outputs). The control of the output number switches 43 and 44 will be described below.

The output number switches 43 and 44 are provided to the flip-flop circuits 31-1 to 31-414. For example, the output number switch 43 is connected to the flip-flop circuits 31-192 at its terminal 43*a*, is connected to the flip-flop circuits 31-193 at its terminal 43*b*, and is connected to a terminal 44*c* of the output number switch 44 at its terminal 43*c*. The output number switch 44 is connected to the flip-flop circuits 31-222 at its terminal 44*b* and is connected to the flip-flop circuits 31-223 at its terminal 44*a*.

According to this, the first flip-flop circuit 31-1 to the 192nd flip-flop circuit 31-192 among the flip-flop circuits 31-1 to 31-414 are, in this order, connected in cascade. The 193rd flip-flop circuit 31-193 to the 222nd flip-flop circuit 31-222 are, in this order, connected in cascade. The 223rd flip-flop circuit 31-223 to the 414th flip-flop circuit 31-414 are, in this order, connected in cascade.

An input of the output pulse width control circuit 47 is connected to the output of the input pulse width monitoring circuit 45 and to an input of the flip-flop circuit 31-414 (and an output of the flip-flop circuit 31-413). The shift pulse output terminal 48 is connected to the output of the output pulse width control circuit 47.

[Operation]

The output switching control portion 40 connects in cascade a group of the flip-flop circuits respectively corresponding to different output numbers among the plurality of the flip-flop circuits 31-1 to 31-414, and performs a switching control for outputting output grayscale voltages to the liquid crystal panel 10 from a group of output portions respectively corresponding to the group of the flip-flop circuits, among the plurality of the output portions 38-1 to 38-414. This will be explained below.

The first specification (the 414 outputs) will be explained at first.

Figure 4A:
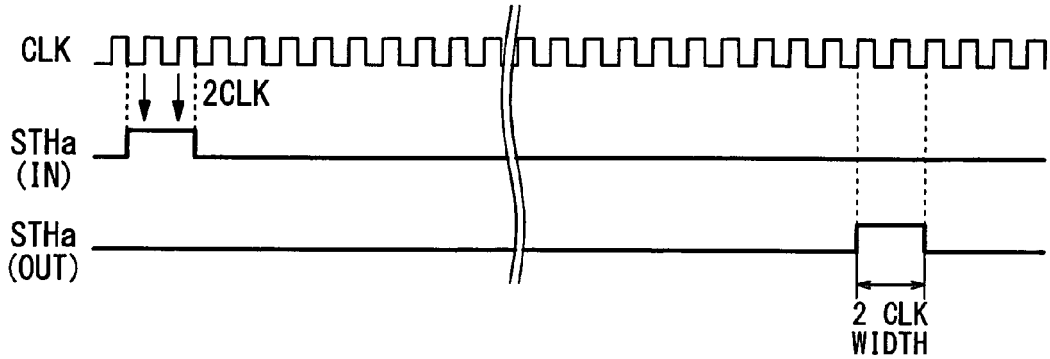
FIG. 4A is an example of a timing chart showing a relation between the clock signal CLK and first specification shift pulse STHa according to the embodiment of the present invention.

As described above, the timing controller 2 supplies the clock signal CLK and the display data DATA of a single line to the respective source drivers 30, and supplies the shift pulse signal STH to the source driver 30 in the first stage. Then, in the case of the first specification, the timing controller 2 outputs the first specification shift pulse STHa as the above mentioned shift pulse signal STH to the source driver 30 in the first stage. A pulse width of this first specification shift pulse STHa corresponds to the P periods of the clock signal CLK. FIG. 4A is an example of a timing chart showing a relation between the clock signal CLK and first specification shift pulse STHa. In this example, the pulse width of this first specification shift pulse STHa corresponds to two periods (P=2) of the clock signal CLK. That is, the pulse width of the first specification shift pulse STHa varies depending on the specification, and the two periods of the clock signal CLK represents the output number "414" in this example.

In each source driver 30, the above described first specification shift pulse STHa is supplied to the shift pulse input terminal 41. Since the pulse width of the first specification shift pulse STHa supplied to the shift pulse input terminal 41 corresponds to the two periods of the clock signal CLK, the input pulse width monitoring circuit 45 outputs the first specification control signal indicating the above mentioned "2". Based on this first specification control signal "2", the output number control circuit 46 selects a setting output number (hereinafter referred to as the output number "414") corresponding to the first specification shift pulse STHa among the output numbers "414" and "384". The output number control circuit 46 connects the terminals 43*a* and 43*b* of the output number switch 43 so that the flip-flop circuit 31-192 and the flip-flop circuit 31-193 can be connected to each other and connects the terminals 44*a* and 44*b* of the output number switch 44 so that the flip-flop circuit 31-222 and the flip-flop circuit 31-223 can be connected to each other, based on the first specification control signal "2" from the input pulse width monitoring circuit 45. That is, the output number control circuit 46 controls the output number switches 43 and 44 so that the group of the first specification flip-flop circuits which includes 414 number of the flip-flop circuits 31-1 to 31-414 are selected and these are connected to each other in cascade (refer to the path A in FIG. 3).

Due to the selection of the flip-flop circuits 31-1 to 31-414, the group of the first specification output portions 38-1 to 38-414, 414 number of the output portions, are selected. The shift pulse shaping circuit 42 shapes the first specification shift pulse signal STHa supplied to the shift pulse input terminal 41 and outputs a signal to the flip-flop circuit 31-1 as the shaped shift pulse signal STH so that the output portions 38-1 to 38-414 can load the group of the first specification display data, 414 pieces of the display data, at a predetermined timing.

Then, in each source driver 30, the flip-flop circuits 31-1 to 31-414 shift the shaped shift pulse signal STH in turn in synchronization with the clock signal CLK, respectively, and output them to the output portions 38-1 to 38-414, respectively. The shaped shift pulse signal STH is outputted from the input of the flip-flop circuit 31-414 (the output of the flip-flop circuit 31-413) to the output pulse width control circuit 47. The output pulse width control circuit 47 shapes the shaped shift pulse signal STH so that a pulse width of the shaped shift pulse signal STH corresponds to two periods of the clock signal CLK based on the first specification control signal of "2" from the input pulse width monitoring circuit 45, and outputs the shaped pulse as the first specification shift pulse signal STHa to a shift pulse input terminal 41 of the next source driver 30 via the shift pulse output terminal 48. In the last source driver 30, the flip-flop circuits 31-1 to 31-414 shift the shaped shift pulse signal STH in turn in synchronization with the clock signal CLK, respectively, and outputs them to the output portions 38-1 to 38-414, respectively.

In each source driver 30, the output portions 38-1 to 38-414 load 414 pieces of display data from the timing controller 2 in synchronization with the shaped shift pulse signals STH from the flip-flop circuits 31-1 to 31-414, respectively. The output portions 38-1 to 38-414 perform the level conversion and digital/analog conversion on the display data, respectively, and output 414 number of output grayscale voltages corresponding to the 414 pieces of display data to 414 number of data lines, respectively.

The second specification (the 384 outputs) will be explained next.

Figure 4B:
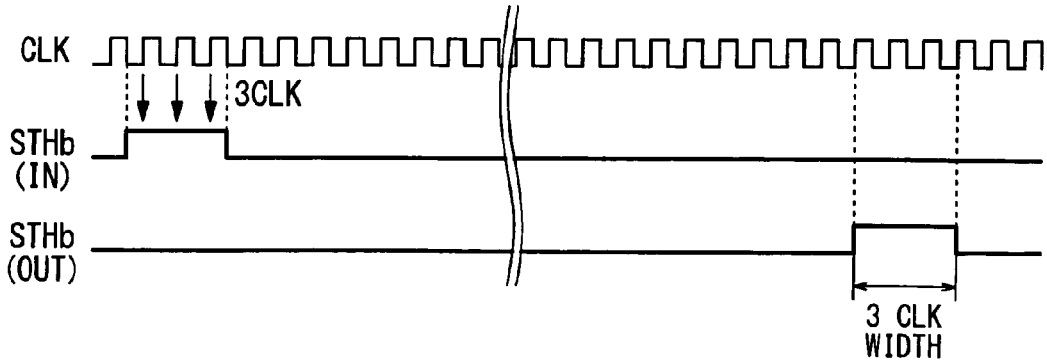
FIG. 4B is an example of a timing chart showing a relation between the clock signal CLK and second specification shift pulse STHb according to the embodiment of the present invention.

As described above, the timing controller 2 supplies the clock signal CLK and the display data DATA of a single line to the respective source drivers 30, and supplies the shift pulse signal STH to the source driver 30 in the first stage. Then, in a case of the second specification, the timing controller 2 outputs the second specification shift pulse STHb as the above mentioned shift pulse signal STH to the source driver 30 in the first stage. A pulse width of this second specification shift pulse STHb corresponds to the Q periods of the clock signal CLK. FIG. 4B is an example of a timing chart showing a relation between the clock signal CLK and second specification shift pulse STHb. In this example, the pulse width of this second specification shift pulse STHb corresponds to three periods (P=3) of the clock signal CLK. That is, the pulse width of the second specification shift pulse STHb varies depending on the specification, and the three periods of the clock signal CLK represent the output number "384".

In each source driver 30, the above described second specification shift pulse STHb is supplied to the shift pulse input terminal 41. Since the pulse width of the second specification shift pulse STHb supplied to the shift pulse input terminal 41 corresponds to the three periods of the clock signal CLK, the input pulse width monitoring circuit 45 outputs the second specification control signal indicating the above mentioned "3". Based on this second specification control signal "3", the output number control circuit 46 selects the setting output number (hereinafter referred to as the output number "384")

corresponding to the second specification shift pulse STHb among the output numbers "414" and "384". The output number control circuit 46 connects the terminals 43*a* and 43*c* of the output number switch 43 and connects the terminals 44*a* and 44*c* of the output number switch 44, depending on the second specification control signal "3" from the input pulse width monitoring circuit 45 so that the flip-flop circuit 31-192 and the flip-flop circuit 31-223 can be connected to each other. That is, the output number control circuit 46 controls the output number switches 43 and 44 so that the group of the second specification flip-flop circuits which includes 384 number of the flip-flop circuits 31-1 to 31-192 and 31-223 to 31-414 among the 414 number of the flip-flop circuits 31-1 to 31-414 are selected and these are connected to each other in cascade (refer to the path B in FIG. 3).

Due to the selection of the flip-flop circuits 31-1 to 31-192 and 31-223 to 31-414, the group of the second specification output portions 38-1 to 38-192 and 38-223 to 38-414, 384 number of the output portions, are selected. The shift pulse shaping circuit 42 shapes the second specification shift pulse signal STHb supplied to the shift pulse input terminal 41 and outputs the signal to the flip-flop circuit 31-1 as the shaped shift pulse signal STH so that the output portions 38-1 to 38-192 and 38-223 to 38-414 can load the group of the second specification display data, 384 pieces of the display data, at a predetermined timing.

Then, in each source drivers 30, the flip-flop circuits 31-1 to 31-192 and 31-223 to 31-414 shift the shaped shift pulse signal STH in turn in synchronization with the clock signal CLK, respectively, and outputs them to the output portions 38-1 to 38-192 and 38-223 to 38-414. The shaped shift pulse signal STH is outputted from the input of the flip-flop circuit 31-414 (the output of the flip-flop circuit 31-413) to the output pulse width control circuit 47. The output pulse width control circuit 47 shapes the shaped shift pulse signal STH so that a pulse width of the shaped shift pulse signal STH corresponds to three periods of the clock signal CLK based on the second specification control signal "3" from the input pulse width monitoring circuit 45, and outputs the shaped pulse as the second specification shift pulse signal STHb to a shift pulse input terminal 41 of the next source driver 30 via the shift pulse output terminal 48. In the last source driver 30, the flip-flop circuits 31-1 to 31-192 and 31-223 to 31-414 shift the shaped shift pulse signal STH in turn in synchronization with the clock signal CLK, respectively, and outputs them to the output portions 38-1 to 38-192 and 38-223 to 38-414, respectively.

In each source driver 30, the output portions 38-1 to 38-192 and 38-223 to 38-414 load 384 pieces of display data from the timing controller 2 in synchronization with the shaped shift pulse signals STH from the flip-flop circuits 31-1 to 31-192 and 31-223 to 31-414, respectively. The output portions 38-1 to 38-192 and 38-223 to 38-414 perform the level conversion and digital/analog conversion on the display data, respectively, and output 384 number of output grayscale voltages corresponding to the 384 pieces of display data to 384 number of data lines.

[Effectiveness]

Effectiveness of the TFT liquid crystal display device 1 according to the embodiment of the present invention will be explained next.

As mentioned above, in the TFT liquid crystal display device 1 according to the embodiment of the present invention, the specification of the source driver 30 can be switched to one of a plurality of the specifications (the 414 outputs and the 384 outputs). The shift pulse signal STH represents one of the specification shift pulses among a plurality of the specification shift pulses STHa and STHb, and a plurality of the specification shift pulses STHa and STHb represents different output numbers "414" and "384", respectively. Then, in the TFT liquid crystal display device 1, the above mentioned shift pulse signal STH (the first specification shift pulse signal STHa or the second specification shift pulse signal STHb) is supplied to the source driver 30. As described above, in the TFT liquid crystal display device 1, it is enough to provide the shift pulse input terminal 41 for supplying the above mentioned shift pulse signal STH (STHa or STHb) to the source driver 30 on a chip, and it is not required to provide the above mentioned output number control terminal on the chip.

In addition, in the TFT liquid crystal display device 1 according to the embodiment of the present invention, it is not required to mount a device for supplying an output number control signal to the output number control terminal and a device for setting a signal level of the output number control signal on the TFT liquid crystal display device 1. In this case, wirings for connecting the above mentioned devices to the output number control terminal are not required. This realizes narrowing a frame of non-displayed area portion on a periphery of a liquid crystal panel. In addition, costs for mounting the above mentioned devices and for wiring them are not required, and a cost reduction can be realized.

Although the present invention has been described above in connection with several embodiments thereof, it would be apparent to those skilled in the art that those embodiments are provided solely for illustrating the present invention, and should not be relied upon to construe the appended claims in a limiting sense.

What is claimed is:

1. A driver comprising:

a plurality of output portions configured to be synchronized with a shift pulse signal, wherein said shift pulse signal indicates one specification shift pulse signal among a plurality of specification shift pulse signals, wherein said plurality of specification shift pulse signals indicates a plurality of output numbers, which are different from each other based on respective specifications of said plurality of specification shift pulse signals, and wherein said one specification shift pulse signal indicates a setting output number as one output number among said plurality of output numbers;

an output switching control portion configured to select a group of output portions corresponding to said setting output number among said plurality of output portions based on said one specification shift pulse signal; and a plurality of shift register portions configured to be connected to respective output portions of said plurality of output portions and output said shift pulse signals in turn, wherein said group of output portions loads display data in synchronization with said shift pulse signal, and outputs output grayscale voltages corresponding to said display data to a display portion, wherein said output switching control portion connects in cascade a group of shift register portions corresponding to said setting output number among said plurality of shift register portions based on said one specification shift pulse signal, wherein said group of shift register portions is connected to said group of output portions, respectively, and wherein said output switching control portion comprises:

a shift pulse input terminal configured to be supplied with said shift pulse signal;

an input pulse width, monitoring circuit configured to monitor said shift pulse signal supplied to said shift pulse input terminal and to output a specification control signal indicating said setting output number corresponding to said one specification shift pulse signal among said plurality of output numbers;

an output number control circuit configured to connect in cascade said group of shift register portions corresponding to said setting output number among said plurality of shift register portions based on said specification control signal; and a shift pulse shaping circuit configured to shape said one specification shift pulse signal supplied to said shift pulse input terminal into a shaped shift pulse signal and to output said shaved shift pulse signal to a first stage register portion of said group of shift register portions so that a group of output portions corresponding to said group of shift register portions among said plurality of output portions loads said display data at a predetermined timing.

2. The driver according to claim 1, wherein said output switching control portion further comprises a switch configured to be provided in said plurality of shift register portions, and wherein said output number control circuit controls said switch based on said specification control signal so that said group of shift register portions among said plurality of shift register portions is connected in cascade.

3. The driver according to claim 2, wherein pulse widths of said plurality of specification shift pulse signals are different from each other based on said respective specifications.

4. The driver according to claim 1, wherein pulse widths of said plurality of specification shift pulse signals are different from each other based on said respective specifications.

5. The driver according to claim l, wherein said output switching control portion further comprises:

a shift pulse output terminal; and an output pulse width control circuit configured to shape said shaped shift pulse signal from one of an input and an output of a last stage shift register portion among said group of shift register portions into a new one specification shift pulse signal, based on a pulse width of said one specification shift pulse signal supplied to said shift pulse input terminal and to output said new one specification shift pulse signal as said one specification shift pulse signal to a shift pulse input terminal of a next driver through said shift pulse output terminal.

6. The driver according to claim 1, wherein said plurality of shift register portions comprise a first shift register, a second shift register and a third shift register, said second shift register being between said first shift register and said third shift register, and wherein said third shift register inputs the shift pulse signal output from said first shift register when said first shift register and said third shift register are connected in cascade based on said one specification shift pulse signal.

7. A display device comprising:

a display portion;

a timing controller configured to supply display data and a shift pulse signal; and a driver configured to include a plurality of output portions synchronized with said shift pulse signal, wherein said shift pulse signal indicates one specification shift pulse signal among a plurality of specification shift pulse signals, wherein said plurality of specification shift pulse signals indicates a plurality of output numbers, which are different from each other based on respective specifications of said plurality of specification shift pulse signals, wherein said one specification shift pulse signal indicates a setting output number as one output number among said plurality of output numbers, wherein said driver further comprises:

an output switching control portion configured to select a group of output portions corresponding to said setting output number among said plurality of output portions based on said one specification shift pulse signal; and a plurality of shift resister portions configured to be connected to respective said plurality of output portions and output shift pulse signals in turn, wherein said group of output portions loads display data in synchronization with said shift pulse signal, and outputs output grayscale voltages corresponding to said display data to a display portion, wherein said output switching control portion connects in cascade a grow of shift register portions corresponding to said setting output number among said plurality of shift register portions based on said one specification shift pulse signal, wherein said group of shift register portions is connected to said group of output portions, respectively, and wherein said output switching control portion comprises:

a shift pulse input terminal configured to be supplied with said shift pulse signal;

an input pulse width monitoring circuit configured to monitor said shift pulse signal supplied to said shift pulse input terminal and to output a specification control signal indicating said setting output number corresponding to said one specification shift pulse signal among said plurality of output numbers;

an output number control circuit configured to connect in cascade said group of shift register portions corresponding to said setting output number among said plurality of shift register portions based on said specification control signal; and a shift pulse shaping circuit configured to shape said one specification shift pulse signal supplied to said shift pulse input into a shaped shift pulse signal and to output said shaped shift pulse signal to a first stage shift register portion of said group of shift resister portions so that a group of output portions corresponding to said group of shift register portions among said of output portions loads said display data at a predetermined timing.

8. The display device according to claim 7, wherein said output switching control portion further includes a switch configured to be provided in said plurality of shift register portions, and wherein said output number control circuit controls said switch based on said specification control signal so that said group of shift register portions among said plurality of shift register portions is connected in cascade.

9. The display device according to claim 8, wherein pulse widths of said plurality of specification shift pulse signals are different from each other based on said respective specifications.

10. The display device according to claim 7, wherein pulse widths of said plurality of specification shift pulse signals are different from each other based on said respective specifications.

11. The display device according to claim 7, wherein said output switching control portion further includes:

a shift pulse output terminal; and an output pulse width control circuit configured to shape said shaped shift pulse signal from one of an input and an output of a last stage shift register portion among said group of shift register portions into new one specification shift pulse signal, based on a pulse width of said one specification shift pulse signal supplied to said shift pulse input terminal and to output said new one specification shift pulse signal as said one specification shift pulse signal to a shift pulse input terminal of a next driver through said shift pulse output terminal.

* * * * *